US009284715B2

(12) United States Patent
Trevisani et al.

(10) Patent No.: US 9,284,715 B2
(45) Date of Patent: Mar. 15, 2016

(54) DEVICE FOR DIGGING DIAPHRAGMS

(71) Applicant: SOILMEC S.p.A., Cesena (FC) (IT)

(72) Inventors: Stefano Trevisani, Cesena (IT); Ezio Biserna, Longiano (IT); Jasmin Curic, San Mauro Pascoli (IT); Marco Pedrelli, Cesena (IT)

(73) Assignee: SOILMEC S.P.A., Cesena (FC) (IT)

( * ) Notice: Subject to any disclaimer, the term of this patent is extended or adjusted under 35 U.S.C. 154(b) by 30 days.

(21) Appl. No.: 14/485,939

(22) Filed: Sep. 15, 2014

(65) Prior Publication Data

US 2015/0128458 A1 May 14, 2015

(30) Foreign Application Priority Data

Sep. 17, 2013 (IT) ..... M12013A1529

(51) Int. Cl.
*E02F 3/47* (2006.01)
*E02D 17/13* (2006.01)
*E02F 3/14* (2006.01)

(52) U.S. Cl.
CPC ..... *E02F 3/475* (2013.01); *E02D 17/13* (2013.01); *E02F 3/144* (2013.01)

(58) Field of Classification Search
USPC ..... 37/184, 461
IPC ..... E02F 3/47,3/475
See application file for complete search history.

(56) References Cited

U.S. PATENT DOCUMENTS 3,627,371 A * 12/1971 Billings ..... B66C 3/16 37/187
4,481,989 A * 11/1984 Peters ..... A01G 23/065 144/24.12
5,715,614 A * 2/1998 Ookuwa ..... A01G 23/046 172/689
9,151,011 B2 * 10/2015 Trevisani ..... E02D 17/13

FOREIGN PATENT DOCUMENTS

EP 2484837 8/2012

* cited by examiner

*Primary Examiner* — Gary Hartmann
(74) *Attorney, Agent, or Firm* — Lucas & Mercanti, LLP.

(57) ABSTRACT

Disclosed a device for digging diaphragms, including a framework and a half-shell support body, fixed in the lower part of the framework, which supports a first pair of half-shells moved to open and close by a first actuation system. The device also has a reservoir operatively connected to the first pair of half-shells to contain the soil dug by half-shells. The reservoir is normally positioned between the framework and the half-shells and has a volume configured to contain an amount of soil corresponding to the amount of soil dug by such half-shells during a single operating cycle of the device. The device can also include separation means actuated for isolating the soil contained in the reservoir.

17 Claims, 14 Drawing Sheets

DEVICE FOR DIGGING DIAPHRAGMS

CROSS-REFERENCE TO RELATED APPLICATIONS

The present application claims the priority of Italian Patent Application No. MI2013A001529, filed Sep. 17, 2013, the contents of which are incorporated herein by reference.

FIELD OF THE INVENTION

The present invention refers to a digging device of the clamshell bucket type, usable in the field of foundations and, more specifically, for making structural or water-proofing diaphragms.

BACKGROUND OF THE INVENTION

By structural diaphragm we mean, in short, a trench of great depth configured to isolate a certain portion of soil. The trench, which can have a variable thickness of between a few tens of centimetres and a few meters, can be even hundreds of meters long. Such a trench is made by digging a plurality of rectangular sectors in sequence. Each of these rectangular sectors is filled with cement mixture and, if necessary, can be reinforced with a steel cage or with IPE beams.

The equipment mainly configured for digging the rectangular sectors that form a structural diaphragm are hydraulic or cable-operated buckets and milling cutters. Buckets and milling cutters both have the feature of being hung from a carrying machine through a cable unwound from a winch. Such a carrying machine generally consists of a tracked undercarriage, a turret rotating with respect to the carriage and an arm able to tilt with respect to the turret, on which the bucket or the milling cutter is hung. Conventionally, the machine is a crane or a driller. The body of the bucket and/or of the milling cutter is sufficiently long and heavy to self-guide into the soil being dug, as if it were a pendulum. In some cases, in the presence of certain geological configurations or deep excavations, such buckets and milling cutters can be provided with means for measuring the deviation and with verticality correction devices, commonly known in the field as flaps, grip rollers, shoes, etc.

In particular, a bucket is provided, in the lower part of its body, with a pair of half-shells or jaws that provide the rectangular digging section. These half-shells are driven by a system of cables and pulleys in the so-called cable-operated or mechanical bucket, and by a hydraulic piston in the hydraulic bucket. The extraction of the debris is carried out by lifting the entire bucket from the bottom of the excavation up to ground surface level, where such a bucket is emptied, usually directly onto a dumper.

Milling cutters are more mechanically complex and more expensive with respect to buckets because they are equipped with cutting wheels and hydraulic pumps for sucking up debris and their use requires more hydraulic power. Milling cutters, since they are heavier than buckets, offer better guarantees of verticality but their use is only advantageous in hard ground, in which they perform better than buckets, and in very deep excavations.

Buckets, on the other hand, are simpler and more cost-effective than milling cutters in terms of their production and subsequent maintenance. Buckets require less power than milling cutters, but they have the drawback of reaming the walls of the hole made during every transit step both going down and coming up (the excavation is of the discontinuous type). They have a relatively limited storage capacity during each individual operating cycle. In hard ground, moreover, the forward movement of a bucket is extremely limited and must be aided with the help of bits and grapnels. Finally, it is clear that a bucket becomes less effective as the depth of the excavation increases, since it also increases the time taken to obtain an ever increasing volume of material extracted.

Irrespective of whether or not it is advantageous to use a bucket rather than a milling cutter, it should be noted that current buckets are not free of drawbacks. The bucket, since it has to be inserted and extracted many times into the excavation in order to reach the desired depth, must necessarily be simple in use and in construction. During ascent and descent, in addition to winding up and unwinding the support cable, it is also necessary to wind up and unwind all of the hydraulic tubes and electrical cables that drive the actuators of the bucket and this involves mechanical complications, greater wear, greater exposure to damage and additional costs. In most cases this means that it is preferred to supply just the cylinder that drives the half-shells and that, in some cases, cable-operated mechanical buckets are preferred. The depth of 40-70 meters is conventionally the one which defines this virtual limit of advantageousness, considering that when excavations become deep there is a need to equip buckets both with additional equipment to control verticality, and with correction flaps driven by hydraulic actuators. The aforementioned considerations are also based on the analysis of how depth influences the times of the operating cycle of a standard bucket, which is carried out in six distinct steps:

1) positioning on the excavation;
2) descent into the stabilizing fluid (if present) down to the bottom of the excavation;
3) partial ascent, release into free fall of the cable so that the half-shells penetrate into the bottom of the excavation, closing of the half-shells and collection of the soil to be removed (active step); this step can be repeated many times depending on the type of soil and the ease of filling;
4) ascent from the bottom of the excavation with the half-shells full with soil until the bucket has been completely extracted from the excavation;
5) rotation of the carrying machine in the direction of the dumper or of the pile;
6) unloading of the bucket.

In order to reach the desired digging depth, the aforementioned cycle must be repeated a number of times that is proportional to the volume of soil that can be removed in each cycle. Steps 1, 3, 5 and 6 last the same time irrespective of the depth reached in the excavation. Steps 2 and 4, on the other hand, have a duration that is proportional to the depth of the excavation. In the first meters the depth of the excavation has practically no influence on the cost-effectiveness of the single operating cycle, but as the depth increases the duration of steps 2 and 4 tends to exceed, even greatly, the sum of the duration of the other four steps.

There are margins of improvement, even if they are rather small. The ascent step is regulated by the speed of the winch, but the closed bucket loaded with debris that rises along the excavation full of stabilizing liquid behaves like the piston of a syringe. Therefore, it is not suitable to excessively increase the speed of ascent of the bucket, since it would promote a sucking effect that could compromise the stability of the walls of the excavation.

The descent step leaves some margin of intervention. By creating suitable openings and discharges in the structure of the bucket or half-shells, i.e. by attending to the hydrodynamics of the planes and surfaces, it is possible to facilitate the outflow of stabilization fluid through the bucket itself, so as to reduce the descent time into the excavation, but the gain would not be very appreciable (see document EP 2 484 837 A1, described in greater detail hereafter).

It may be more suitable to optimise the load capacity of the bucket, attempting to increase the amount of material extracted during each single operating cycle. In this way, each cycle would become more economically profitable, at the same time reducing the number of cycles to make an excavation of predetermined depth, by virtue of the increased storage volume.

In the state of the art attempts have been made to reduce the unproductive times of the operating steps of buckets, as well as to increase the storage capacity that can be exploited in every single cycle. For example, document EP 2 484 837 A1 proposes to improve the hydrodynamics of an empty bucket in its descent towards the bottom of the excavation, thanks to the presence of openings or holes obtained in the top of the open half-shells. This characteristic should facilitate the outflow of stabilization fluid of the excavation from below to above the bucket. The size of these openings or holes is however limited by the geometry of the half-shells and therefore the reduction in friction is minimal, just as the reduction in descent time of the bucket is minimal.

Document EP 1 614 813 A1 in the name of the same Applicant proposes a bucket-equipped apparatus still hung from a cable and configured to be dropped into an excavation, but in which the bucket is made up of four tubes of large diameter, welded tangentially to each other so as to be configured in a rectangle that represents the dimensions of the excavation to be made. The tubes are arranged in the excavation in the vertical direction. Every tube, of a length of a few meters, carries a hydraulic motor at its top, which sets a helix element that is as long as the tube and that projects beneath the tube itself into right-handed rotation. Each helix is equipped with teeth in its lower part. The helixes, in the portion outside the tube, are interpenetrating so as to make an excavation comparable to four slightly intersecting circumferences. The helixes, in their rotation motion, carry the dug material inside the tubes. When the apparatus is full, it is extracted from the excavation and it is emptied, rotating the helixes in the anticlockwise direction.

This kind of apparatus it thus intended to make excavations of equivalent section to that of a standard bucket, but exploiting the volume represented by the height of the tubes, able to hold more than the half-shells, in order to be able to carry more material in each cycle. In reality, such an effect is obtained only in reduced form, particularly in the presence of loose sands, due to the presence of the stabilization fluid of the hole. Indeed, in practice, the volume of the extracted material is only a fraction of the theoretical volume since the flow of stabilizing liquid, which passes through the framework of the apparatus, which is not really hydrodynamic, disperses a great deal of the dug material, which falls to the bottom of the excavation. Such an apparatus also has the drawback of taking longer to be filled, particularly in the presence of cohesive soil. Moreover, it is necessary to make the hydraulic plant more complicated and to have high power to supply the motors of the helixes.

SUMMARY OF THE INVENTION

The aim of the present invention is therefore to provide a device for digging diaphragms, of the clamshell bucket type, which is able to overcome the aforementioned drawbacks of the prior art in an extremely simple, cost-effective and particularly functional manner.

In detail, an object of the present invention is to provide a device for digging with a bucket that, for the same digging section, has a storage capacity of the soil dug that is tangibly greater than that of a conventional bucket. This object according to the present invention is achieved by providing a device for digging with a bucket that maintains the simplicity of construction and of use of current buckets, also limiting the motorisations required for additional actuations.

The device for digging with a bucket according to the present invention, while being more efficient with respect to analogous known devices, is particularly simple and aimed at the lowest possible cost. Such a device, proposed in two different embodiments, requires a lengthening of the time to carry out the aforementioned steps 3 and 6, but offers a substantially greater storage capacity with respect to that of a conventional bucket. By analysing the duration of the operating cycles as a function of depth, the device for digging with a bucket according to the present invention also offers the possibility of using the bucket in the conventional way in the first tens of meters of the excavation, in other words not exploiting the increased load capacity, so as not to lengthen the times of steps 3 and 6, and instead exploiting the cumulative capacity only when the duration of the descent and ascent steps is substantial.

BRIEF DESCRIPTION OF THE DRAWINGS

The characteristics and advantages of a device for digging with a bucket according to the present invention will become more apparent from the following description, given as a non-limiting example, referring to the attached schematic drawings, in which.

DETAILED DESCRIPTION OF THE INVENTION

Figure 1:
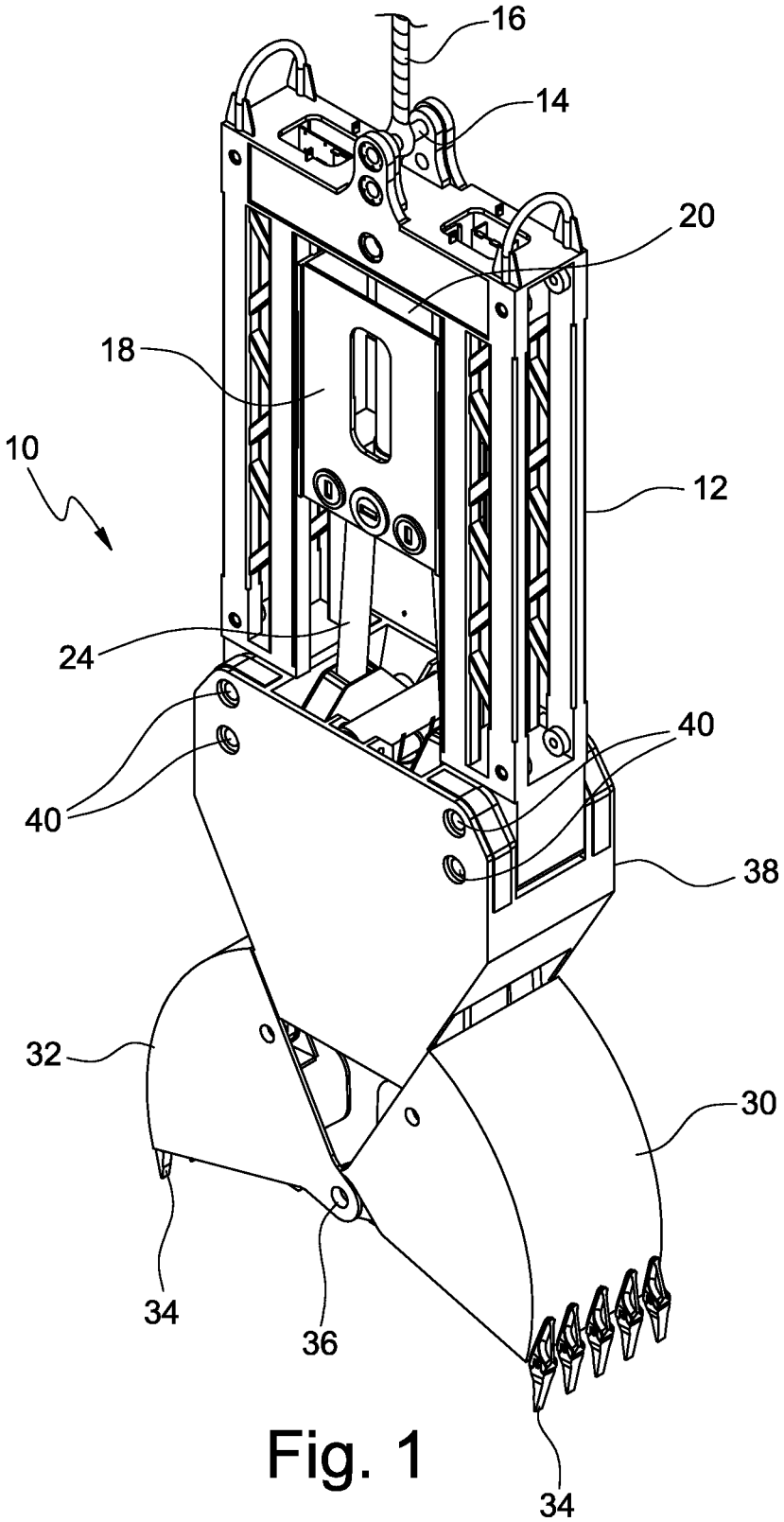
FIG. 1 is a perspective view of a first embodiment of a device for digging with a bucket according to the present invention.

With reference to the figures, two distinct embodiments of a device for digging with a bucket according to the present invention are shown, wholly indicated with reference numeral 10.

The device 10 comprises a bearing framework 12 fastened, through a pin 14 arranged on top of the framework in a central area, to a cable 16 that winds onto the winch of support machinery, usually consisting of a tracked undercarriage. Parallel to the cable 16 there is an "umbilical cord" (not represented) of tubes and possibly also of cables (for signals or controls) for the hydraulic services necessary for the movement of all of the components of the device 10.

A trolley 18 is able to slide in a guided manner inside the framework 12. The trolley 18 is moved by a hydraulic cylinder 20, in turn fixedly connected to the framework 12. Two connecting rods 22 and 24 are rotatably connected, at their upper end, to the trolley 18 through respective upper pins 26. The connecting rods 22 and 24 ae symmetrically arranged with respect to the longitudinal axis of the device 10, coinciding with the axis of the bearing cable 16. The lower end of such connecting rods 22 and 24 is rotatably connected, through respective lower pins 28 (FIG. 2B), to two digging half-shells or jaws 30 and 32, equipped with teeth or protuberances 34 configured to sink into the earth.

In the first embodiment of the device 10 shown in FIGS. 1, 2A, 2B and 3A-3J the digging half-shells 30 and 32 are defined as "outer" half-shells. The outer half-shells 30 and 32 preferably but not necessarily have a common rotation axis 36 made on a half-shell support body 38 able to be temporarily fixed in a static manner, with removable means such as for example screws or pins 40, in the lower part of the framework 12. The half-shell support body 38 thus extends below said a framework 12 until it reaches a lower position that is close to the same depth reached by the digging teeth 34 when the outer half-shells 30 and 32 are in open position.

A second hydraulic cylinder 42, preferably fixed in its static part on the half-shell support body 38 through a pin 44, moves a second sliding trolley 46 (FIGS. 2A and 2B) guided on the structure of said a half-shell support body 38. The cylinder 42 could be connected at the top to the framework 12. The second sliding trolley 46 is provided, in its lower part, with two attachments 48 (FIG. 2B) on which, through respective pins 50, another two half-shells or jaws 52 and 54 are hinged. Such half-shells 52 and 54 preferably but not necessarily have distinct rotation axes, defined by the respective pins 50. The shape of the half-shells 52 and 54 is contained in the inner volume of the outer half-shells 30 and 32 and for this reason such half-shells 52 and 54 are defined as "inner" half-shells. The second pair of inner half-shells 52 and 54 is thus configured to be able to be inserted at least temporarily inside the first pair of outer half-shells 30 and 32 and to be completely contained inside said first pair of outer half-shells 30 and 32.

The inner half-shells 52 and 54 are not moved by any connecting rod, they are fixed in their lower part of the second trolley 46 and they have the possibility of sliding vertically for the stroke provided by the second hydraulic cylinder 42. The inner half-shells 52 and 54 can also be equipped, in the area of contact with the ground, with teeth or protuberances 34 configured to sink into the ground.

Figure 2A:
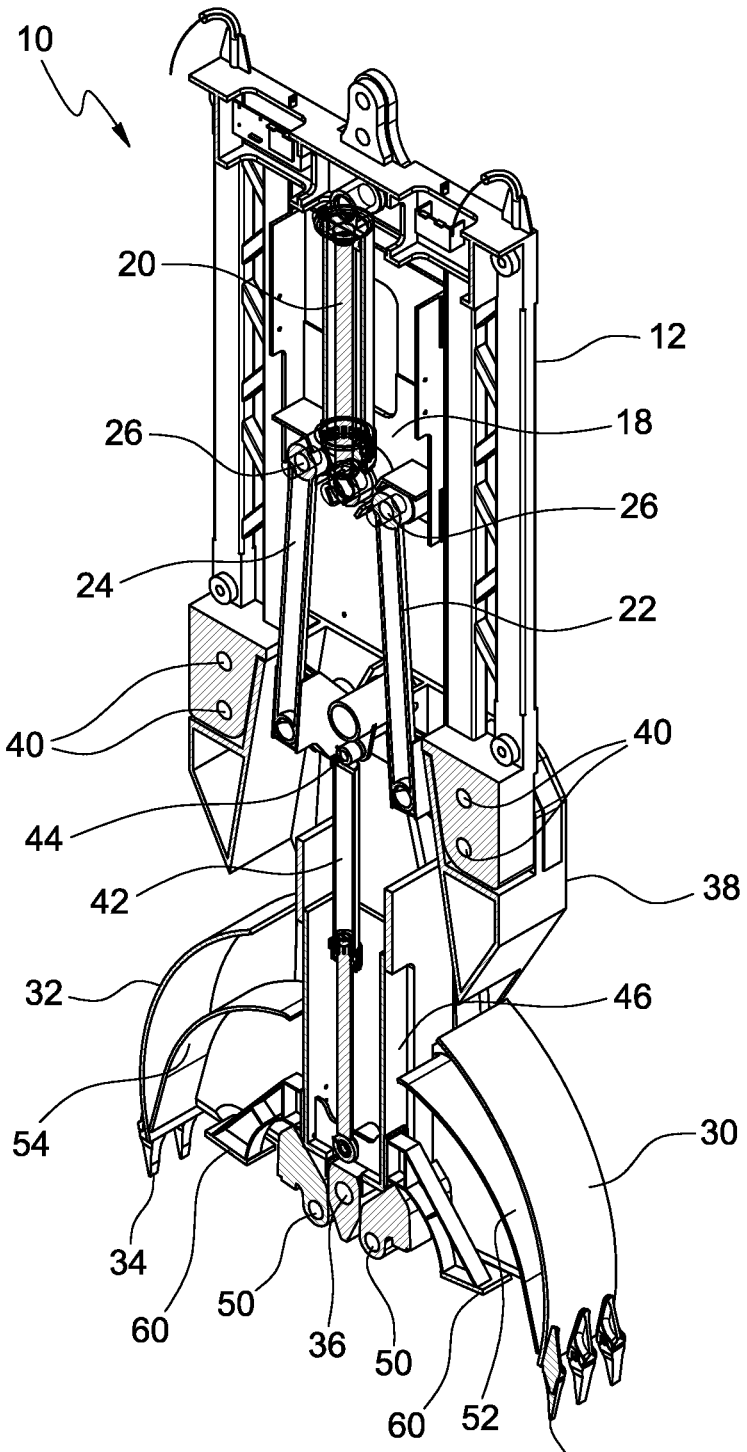
FIG. 2A is a section view of the device for digging with a bucket of FIG. 1 in the configuration with half-shells open.
Figure 2B:
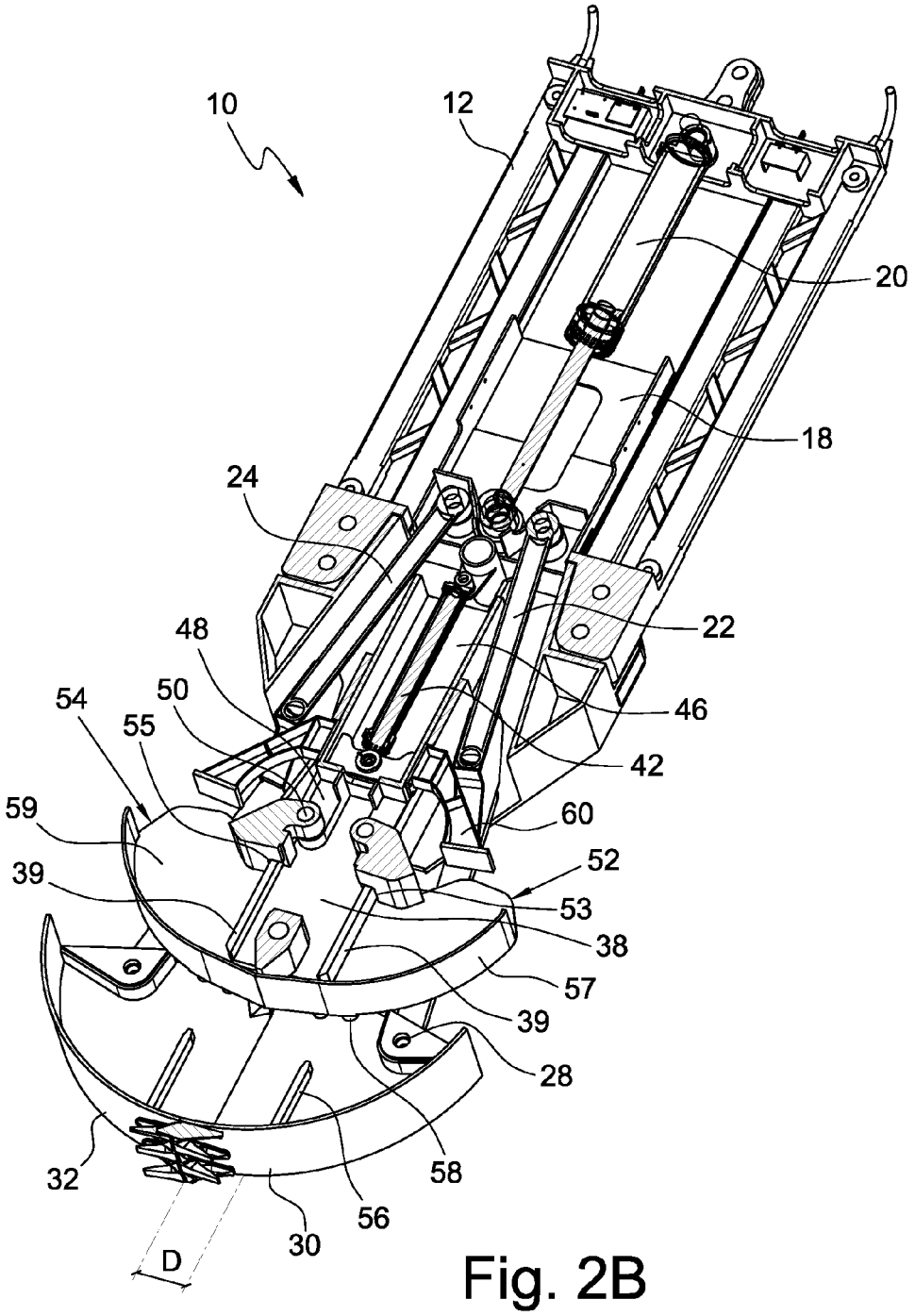
FIG. 2B is a section view of the device for digging with a bucket of FIG. 1 in the configuration with half-shells closed.
Figure 3A:
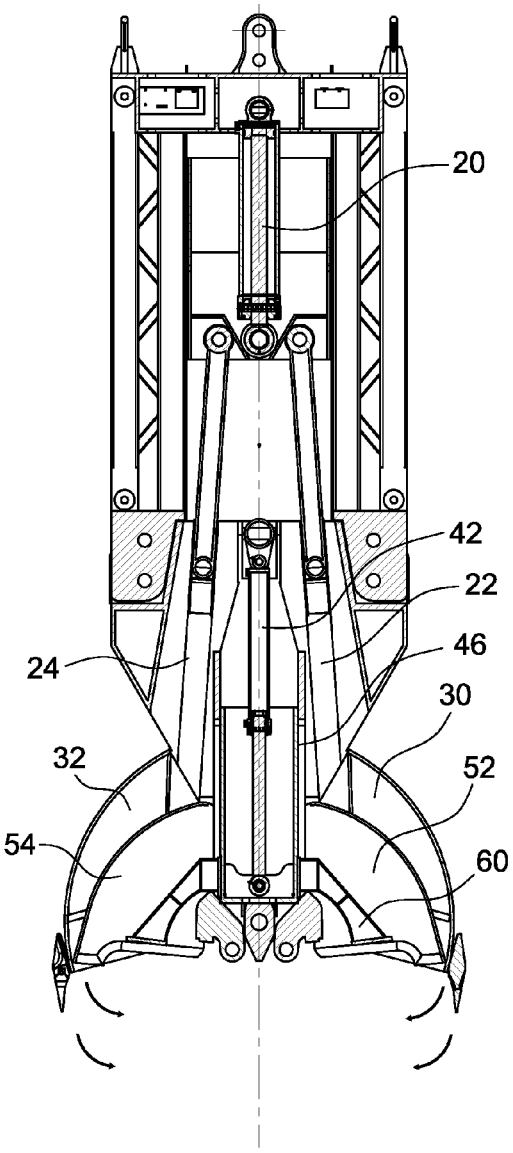
FIGS. 3A-3J are section views showing, in sequence, the different operating steps of a single operating cycle of the device for digging with a bucket of FIG. 1.
Figure 3B:
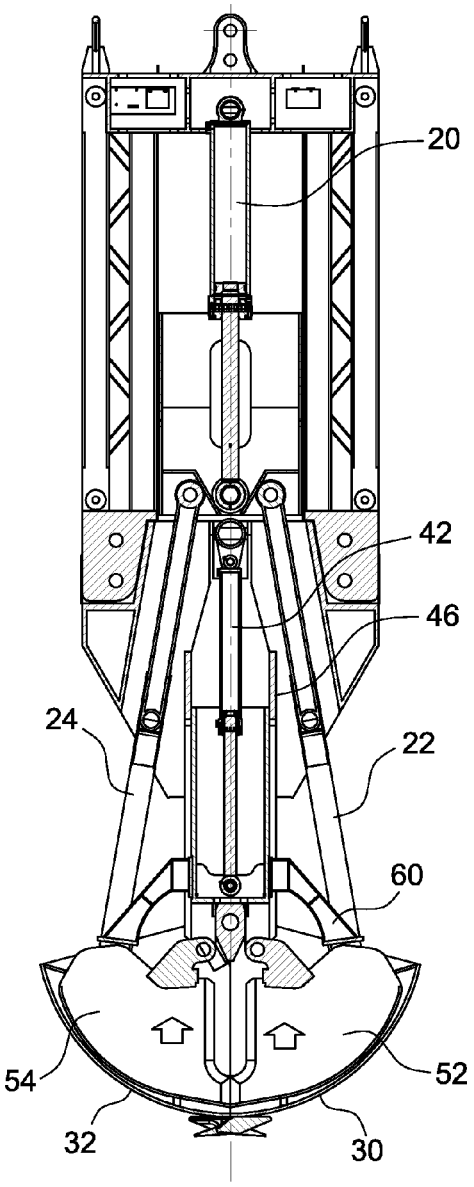
Figure 3C:
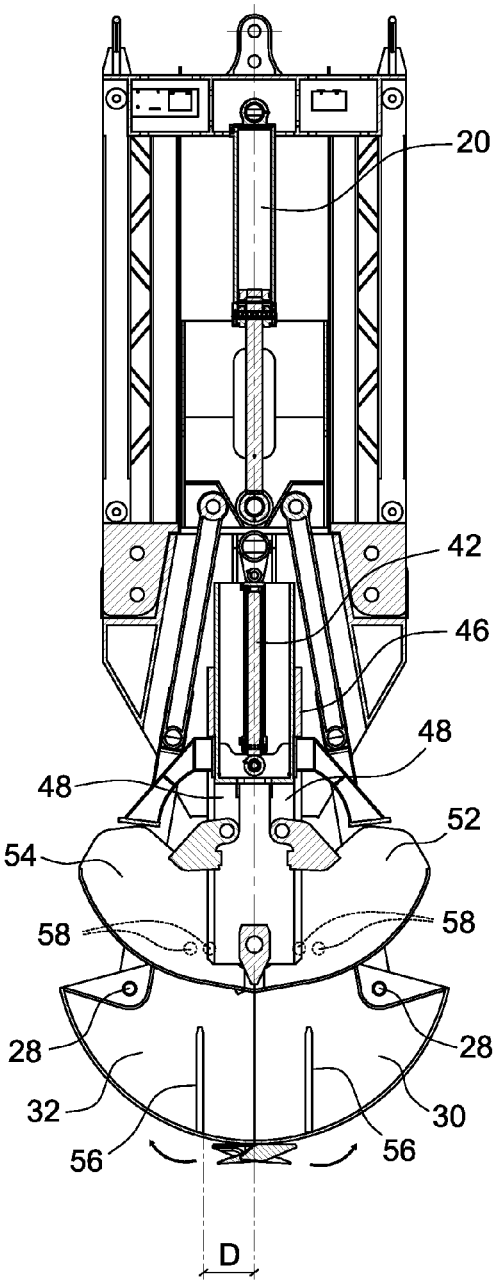
Figure 3D:
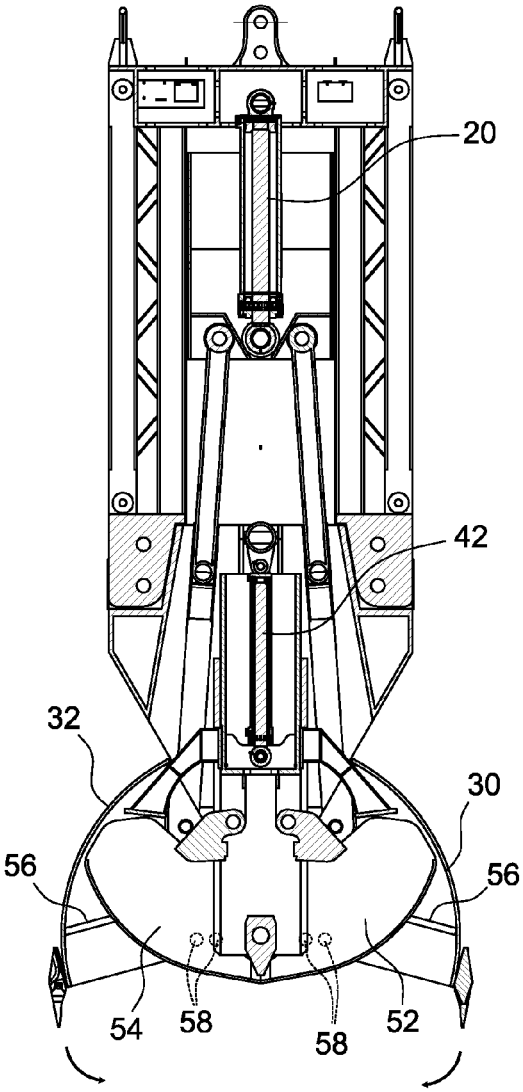
Figure 3E:
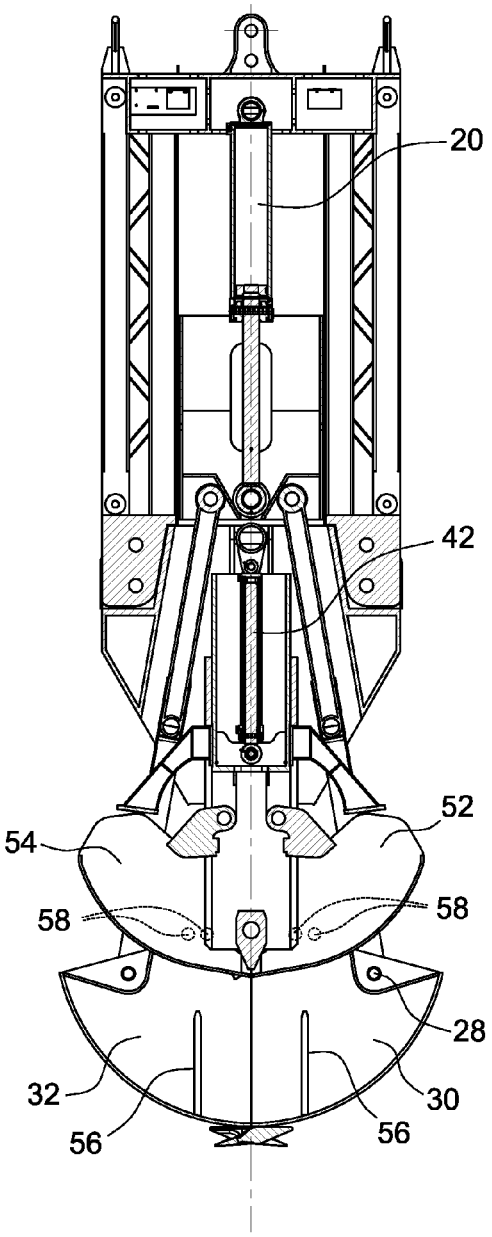
Figure 3F:
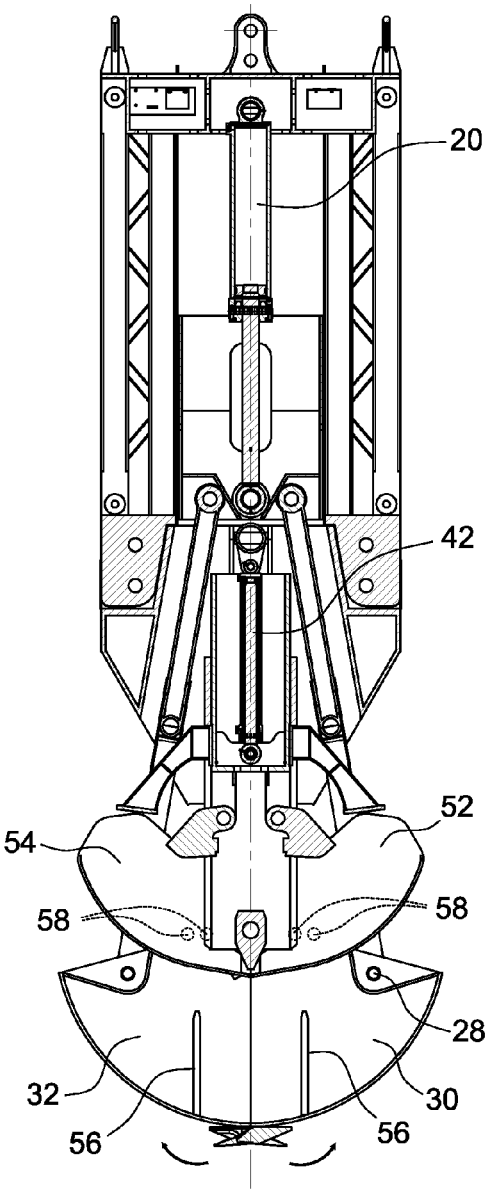
Figure 3G:
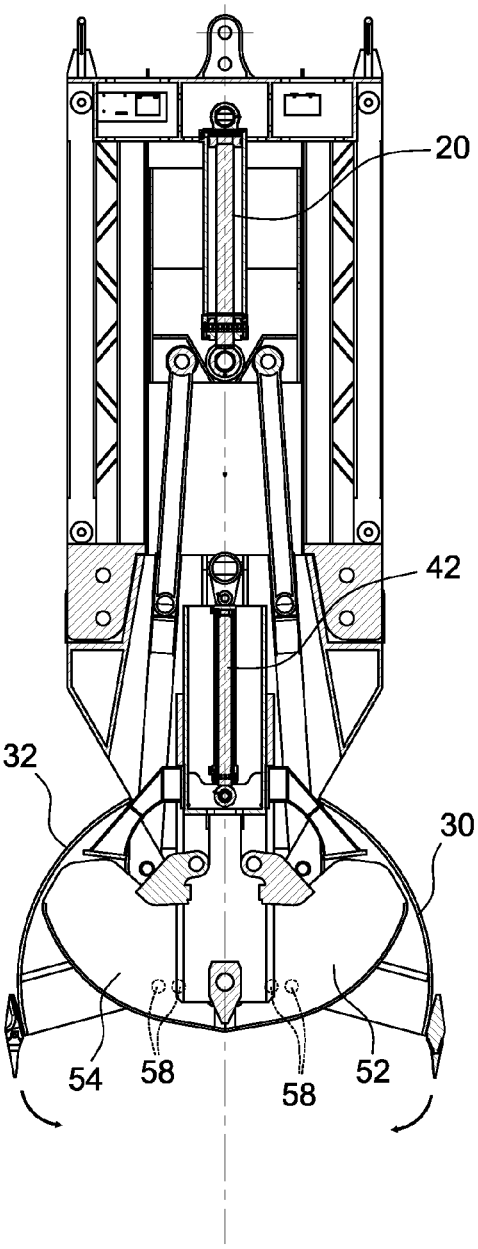
Figure 3H:
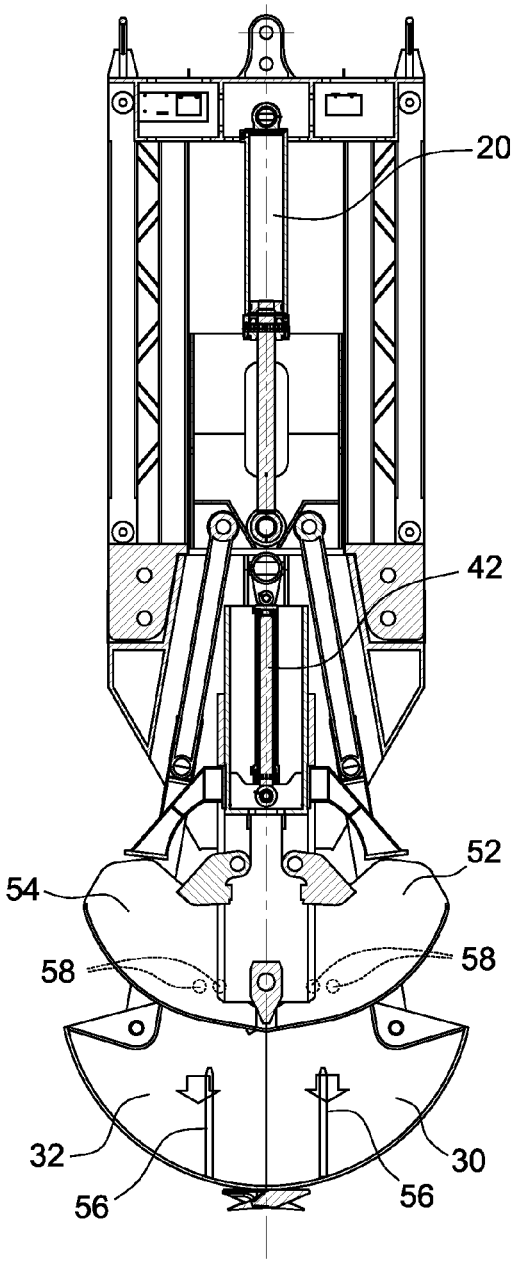
Figure 3I:
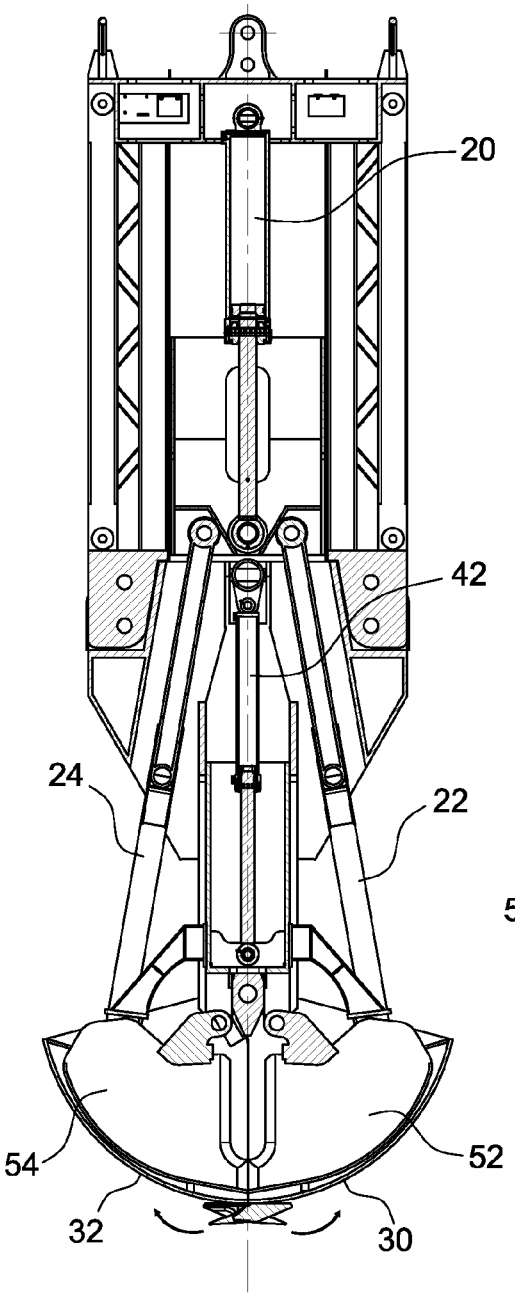
Figure 3J:
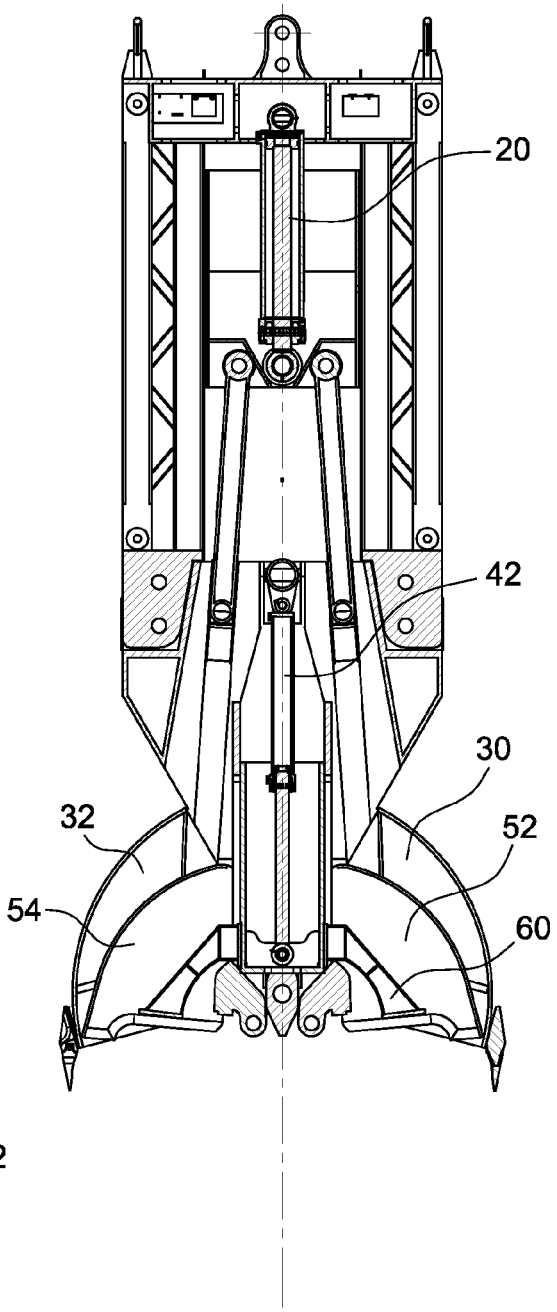

The connecting rods 22 and 24 are monolithic in their upper part, but they preferably fork in their lower part (FIG. 2B). The two legs of this fork move in the gap existing between the inner half-shells 52 and 54 and the outer half-shells 30 and 32. A track 56, of limited height and of length slightly shorter than the stroke of the second hydraulic cylinder 42, is fixed onto both of the inner side walls of each outer half-shell 30 and 32. Each track 56 is fixed at a predefined distance D from the attachment edge of the respective outer half-shell 30 and 32 and is arranged vertically when such outer half-shells 30 and 32 are closed.

In the lower part of both of the outer side walls of each inner half-shell 52 and 54 there are abutment means 58, like for example rollers or idle pins fixed in pairs (two pairs for each inner half-shell) to the inner half-shells 52 and 54 themselves. When both the outer half-shells 30 and 32, and the inner half-shells 52 and 54 are closed, by extending the second hydraulic cylinder 42 it is possible to make both the second trolley 46, and the inner half-shells 52 and 54 slide downwards so that each pair of rollers or idle pins 58 engages at the two opposite sides of each track 56. The outer half-shells 30 and 32 and inner half-shells 52 and 54 are thus temporarily and mutually connected through mechanical means consisting, respectively, of the rails 56 and the abutment means 58. Such mechanical means 56 and 58 are mutually engaged for a limited stroke portion of the second hydraulic cylinder 42, so as to allow the inner half-shells 52 and 54 to disengage from the outer half-shells 30 and 32, as will be specified more clearly hereafter. In a further totally equivalent embodiment, it is possible to fix a pair of rails 56 onto both of the inner side walls of each outer half-shell 30 and 32, so that the channel present between them is at a predetermined distance D from the attachment edge of the respective outer half-shell 30 and 32. Again in this embodiment, on the outer side walls of each inner half-shell 52 and 54 there is an abutment means 58 that can be coupled with the rails 56 inserting in the channel present between them. In any case, it is possible to invert the mounting of the rails 56 and of the abutment means 58, so that such rails 56 are on both of the outer side walls of each inner half-shell 52 and 54 and such abutment means 58 are, on the other hand, on both of the inner side walls of each outer half-shell 30 and 32.

With reference to the configuration represented in FIG. 2B the abutment means 58 are not engaged in the rails 56. With the opening of the cylinder 42 the rollers 58 come into contact with the rails 56 and consequently, mechanically abutting with each other, make the inner half-shells 52 and 54 integral with the outer half-shells 30 and 32. In this configuration, the opening and closing of the outer half-shells 30 and 32, imparted by the actuation system consisting of the trolley 18, the hydraulic cylinder 20 and the two connecting rods 22 and 24, also sets the inner half-shells 52 and 54 in motion, which thus open and close as a unit with the outer half-shells 30 and 32. Such setting in motion may or may not be selected by virtue of the fact that if the abutment means 58 are not engaged with the respective rails 56, the inner half-shells 52 and 54 remain in their configuration. In particular, this occurs when the cylinder 42 is in a configuration close to closing.

Therefore, the outer half-shells 30 and 32, when motorised or actuated, also set the inner half-shells 52 and 54 in motion. The actuation of the first cylinder 20 moves the connecting rods 22 and 24, which open and close about the rotation axis 36 and also set the inner half-shells 52 and 54 in motion. The simultaneous rotary movement of the inner half-shells 52 and 54 and of the outer half-shells 30 and 32 is possible thanks to the closeness of the rotation axes (pins 50) of the inner half-shells 52 and 54 with the shared rotation axis 36 of the outer half-shells 30 and 32, as well as the relative sliding movement that the abutment means 58 are capable of performing along the rails 56. In this operating configuration the inner half-shells 52 and 54 are also motorised, exploiting the actuators of the outer half-shells 30 and 32, thus avoiding complicating the device 10 with the addition of actuators dedicated just to the actuation of the inner half-shells 52 and 54.

At the sides of the second sliding trolley 46 there are ejection means 60 to facilitate the outflow of material when the inner half-shells 52 and 54 are being emptied. The ejection means 60 can preferably be mounted through temporary fastening means on the second sliding trolley 46 so as to always remain fixedly connected to it, or to permanently form part of the second sliding trolley 46 itself.

The structure of the half-shell support body 38 has a central opening so as to allow the ejection means 60 to ascend inside the half-shell support body 38 itself without interference (FIG. 2B). At the side of such an opening, the edges of the structure form guide strips 39. The inner half-shells 52 and 54, in the area of the hinges that form the seats of the pins 50, have grooves 53 and 55 in which the guide strips 39 can slide in mechanical contrast. When both the outer half-shells 30 and 32, and the inner half-shells 52 and 54 are closed, by closing the second hydraulic cylinder 42 it is possible to make both the second trolley 46, and the inner half-shells 52 and 54 slide upwards so that the guide strips 39 engage in the grooves 53 and 55 forming a prismatic coupling. In this operating configuration the inner half-shells 52 and 54 are impeded in rotation and are held in closed position, forced by the prismatic coupling, without the need for dedicated actuators and without being fixedly connected to the outer half-shells 30 and 32, thus being independent from the actuation system 18, 20, 22 and 24 of such outer half-shells 30 and 32.

The different operating steps of a single operating cycle of the device 10 described up to here can therefore be summarised as follows. In a first step (FIG. 3A) the bucket, consisting of the assembly of the outer half-shells 30 and 32 and of the inner half-shells 52 and 54, is empty and slides in descent into the excavation. Both the outer half-shells 30 and 32, and the inner half-shells 52 and 54 are open, the first hydraulic cylinder 20 is closed and the second hydraulic cylinder 42 is withdrawn. The fulcrums 36 and 50 respectively of the outer half-shells 30 and 32 and inner half-shells 52 and 54 are as close together as possible, as also shown in FIG. 2A. The abutment means 58 are engaged in the rails 56 and therefore the outer half-shells 30 and 32 and the inner half-shells 52 and 54 are temporarily and mutually connected.

In a second step (FIG. 3B) the bucket is in contact with the bottom of the excavation. The first hydraulic cylinder 20 is withdrawn, whereas the second hydraulic cylinder 42 is kept open. The connecting rods 22 and 24 close the outer half-shells 30 and 32, which also close the inner half-shells 52 and 54. Only the inner half-shells 52 and 54 fill up with material, defining a closed volume, similar to a reservoir in which the material dug by the outer half-shells 30 and 32 is stored. Such a reservoir is therefore operatively associated with the digging outer half-shells 30 and 32, i.e. distinct from the outer half-shells 30 and 32 but at the same time arranged to receive the material dug by them. The reservoir has a volume configured to contain an amount of soil substantially corresponding to the amount of soil dug by the outer half-shells 30 and 32. Such a step, in certain ground conditions (for example hard ground), could be repeated to improve the loading efficiency.

In a third step (FIG. 3C) the second hydraulic cylinder 42 is closed again, whereas the first hydraulic cylinder 20 is kept open. The inner half-shells 52 and 54, which in the previous steps were integral with the sliding trolley 46, are lifted (vertically translated) by the stroke provided by the second hydraulic cylinder 42. As stated earlier, the rails 56 arranged vertically on the inner side walls of the outer half-shells 30 and 32 are shorter than the stroke generated by the second hydraulic cylinder 42. For this reason, in the end part of the stroke of said second hydraulic cylinder 42, the rollers 58 present on the outer side walls of the inner half-shells 52 and 54 will no longer be in contact with the respective rails 56, actually making the inner half-shells 52 and 54 independent from the outer half-shells 30 and 32. At the same time, during the lifting, the grooves 53 and 55 of the inner half-shells 52 and 54 couple with the guide strips 39 of the half-shells support 38, making a prismatic coupling that impedes the opening rotation of the aforementioned inner half-shells 52 and 54. During this third step the closed volume or reservoir defined by the inner half-shells 52 and 54 is thus lifted, into a "parking" position, below the framework 12 and, preferably, completely below the framework 12 so that said framework 12 can be unmodified with respect to the configurations currently produced by the same Applicant and thus allow the use of existing framework bodies. The walls or shells 57 and 59 (FIG. 2B) of the inner half-shells 52 and 54 act as separation means to isolate, with respect to the outer half-shells 30 and 32, the soil contained in the reservoir defined by the inner half-shells 52 and 54 themselves. The fact that the reservoir is positioned beneath the framework 12 and not inside the framework 12 itself is further advantageous since it makes it possible to best exploit the space inside the framework 12 to optimise the geometry of the actuation system 18, 20, 22 and 24 of the outer half-shells 30 and 32 so as to obtain the maximum operating performance.

In a fourth and fifth step (FIGS. 3D and 3E) the second hydraulic cylinder 42 is kept closed. In the fourth step (FIG. 3D) the first hydraulic cylinder 20 carries out a closing stroke (fourth step, FIG. 3D) so as to open the outer half-shells 30 and 32, while the material already dug and loaded remains stored in the reservoir defined by the inner half-shells 52 and 54. The soil in the reservoir is held by the separation means 57 and 59, while the pair of outer half-shells 30 and 32 is in open configuration.

In the fifth step (FIG. 3E) the first hydraulic cylinder 20 carries out an opening stroke, allowing the outer half-shells 30 and 32, disconnected from the inner ones 52 and 54, to make a second filling. Such a second filling takes place without extracting the bucket from the excavation. At the end of this fifth step the bucket is loaded both with a first amount of material enclosed in a first volume, which is the reservoir defined by the inner half-shells 52 and 54, and with a second amount of material enclosed in the second volume, which is defined by the outer half-shells 30 and 32. Such first and second volumes are distinct from one another.

In a sixth step (FIG. 3F) the entire device 10 rises to the surface, with all of the outer half-shells 30 and 32 and inner half shells 52 and 54 closed and full of material. Once the surface has been reached, the device 10 is ready to unload the material in the predefined collection point.

In a seventh step (FIG. 3G) the device 10 is at the surface, the first hydraulic cylinder 20 is thus closed and the connecting rods 22 and 24 open the outer half-shells 30 and 32 to empty a part of the material loaded from the bucket. The inner half-shells 52 and 54 remain closed. The soil in the reservoir is held by the separation means 57 and 59, whereas the pair of outer half-shells 30 and 32 is in open configuration and unloads. The concave lower outer part of the closed inner half-shells 52 and 54 facilitates the outflow of material from the digging outer half-shells 30 and 32.

In an eighth step (FIG. 3H) the first hydraulic cylinder 20 is withdrawn and the outer half-shells 30 and 32 are arranged in closed position, with the rails 56 in vertical position, ready to guide the inner half-shells 52 and 54 through the rollers 58 fixed in the lower part of said inner half-shells 52 and 54.

In a ninth step (FIG. 3I) the second hydraulic cylinder 42 is withdrawn and the inner half-shells 52 and 54, integral with the trolley 46, descend inside the closed outer half-shells 30 and 32 that are now empty. During such a descent, first the rollers 58 engage at the sides of the rails 56, then the guide strips 39 of the half-shell support body 38 disengage from the grooves 53 and 55 of the inner half-shells 52 and 54.

In a tenth and last step (FIG. 3J) the first hydraulic cylinder 20 is closed, whereas the second hydraulic cylinder 42 remains withdrawn. The fulcrums 36 and 50, respectively, of the outer half-shells 30 and 32 and inner half-shells 52 and 54 are once again as close together as possible. The outer half-shells 30 and 32 open and with them the inner half-shells 52 and 54, which release the material contained inside them facilitated by the ejection means 60 fixed onto the trolley 46. The bucket is thus arranged like in the first step of FIG. 3A and is ready for another operating cycle.

In the second embodiment of the device 10 shown in FIGS. 4, 5 and 6A-6H the digging half-shells 130 and 132 necessarily have distinct rotation axes, made on the half-shell support body 138 and represented by the respective pins 136A and 136B. The half-shell support body 138 is again fixed in a static manner, with screws or pins 140, in the lower part of the framework 12. The half-shell support body 138 thus extends beneath such a framework 12.

The second hydraulic cylinder 142, fixed in its static part on the half-shell support body 138 through a pin 144, moves the second sliding trolley 146 guided on the structure of said a half-shell support body 138. The second sliding trolley 146 is provided, on its side walls, with two attachment protuberances 162 on which, through upper pins 164, two further connecting rods 166 are hinged. Two mechanisms 168 and 170 with compass structure with the arms open at a slightly acute angle, otherwise known as "bolts", are hinged on the pins 136A and 136B about which the half-shells 130 and 132 also rotate. The bolts 168 and 170 receive their rotation movement from the connecting rods 166, to which they are fixed by means of lower pins 172.

The first hydraulic cylinder 20 opens and closes the half-shells 130 and 132, whereas the second hydraulic cylinder 142 makes the bolts 168 and 170 rotate inside the aforementioned half-shells 130 and 132. This second actuation system for moving the mechanisms 168 and 170, consisting of the second hydraulic cylinder 142 and the second sliding trolley 146, is totally independent from the first actuation system 18, 20, 22 and 24 of the outer half-shells 130 and 132. The half-shell support body 138, in its lower part, beneath the framework 12, has a preferably closed structure 174, like for example a reservoir or a pair of symmetrical cases, defined as the natural extension of the outer half-shells 130 and 132. The reservoir 174 is therefore operatively associated with the outer digging half-shells 130 and 132, i.e. distinct from such outer half-shells 130 and 132 but at the same time arranged to receive the material dug by them. Such a reservoir 174 has a volume configured to contain an amount of soil substantially corresponding to the amount of soil dug by the half-shells 130 and 132. The fact that the reservoir 174 is positioned beneath the framework 12, and not inside the framework 12 itself, is advantageous since it allows the space inside the framework 12 to be best exploited to optimise the geometry of the first actuation system 18, 20, 22 and 24 of the outer half-shells 130 and 132, so as to obtain the maximum operating performance. The reservoir 174, in a variant embodiment, could be open at the top so as to improve the outflow of the drilling fluid.

Figure 4:
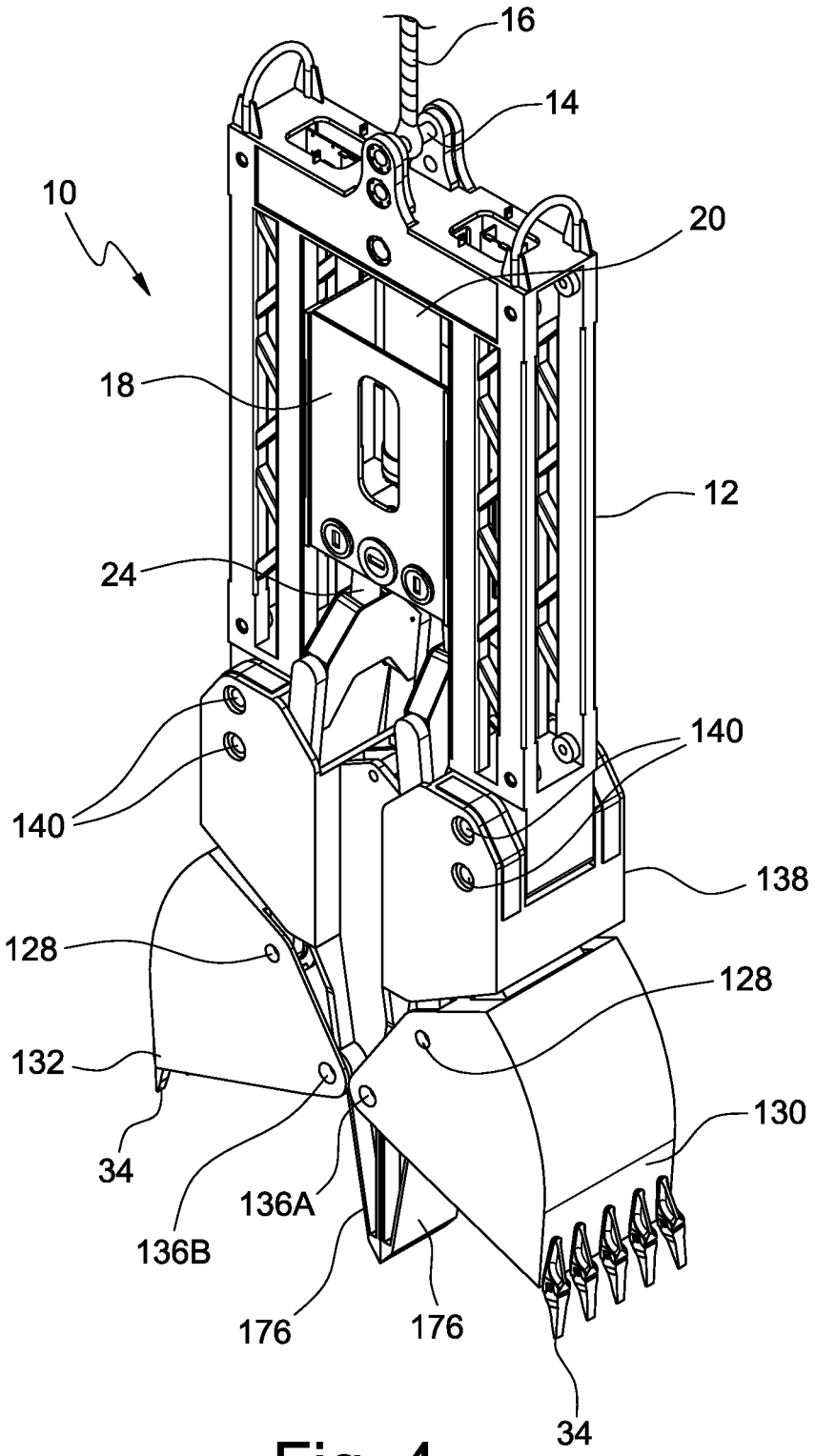
FIG. 4 is a perspective view of a second embodiment of a device for digging with a bucket according to the present invention.
Figure 5:
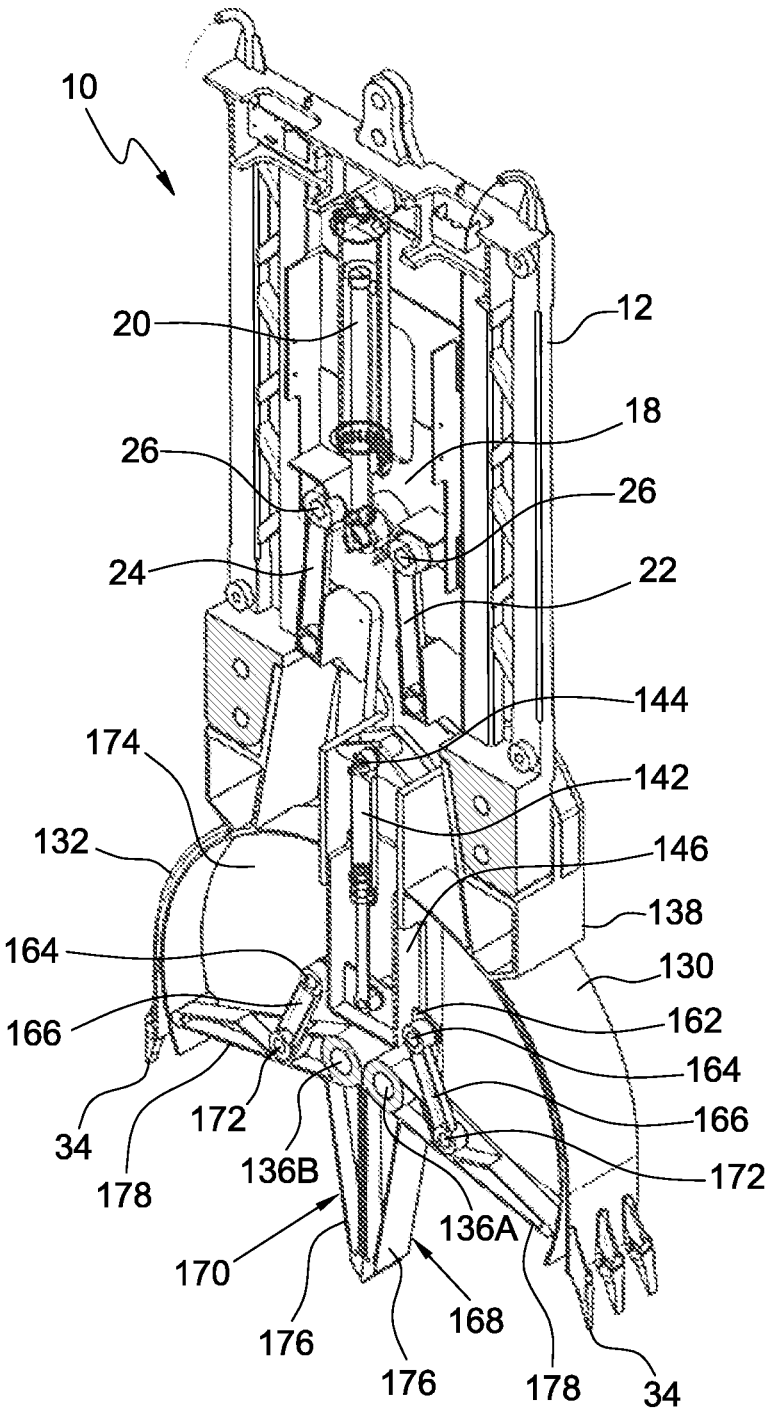
FIG. 5 is a section view of the device for digging with a bucket of FIG. 4.
Figure 6A:
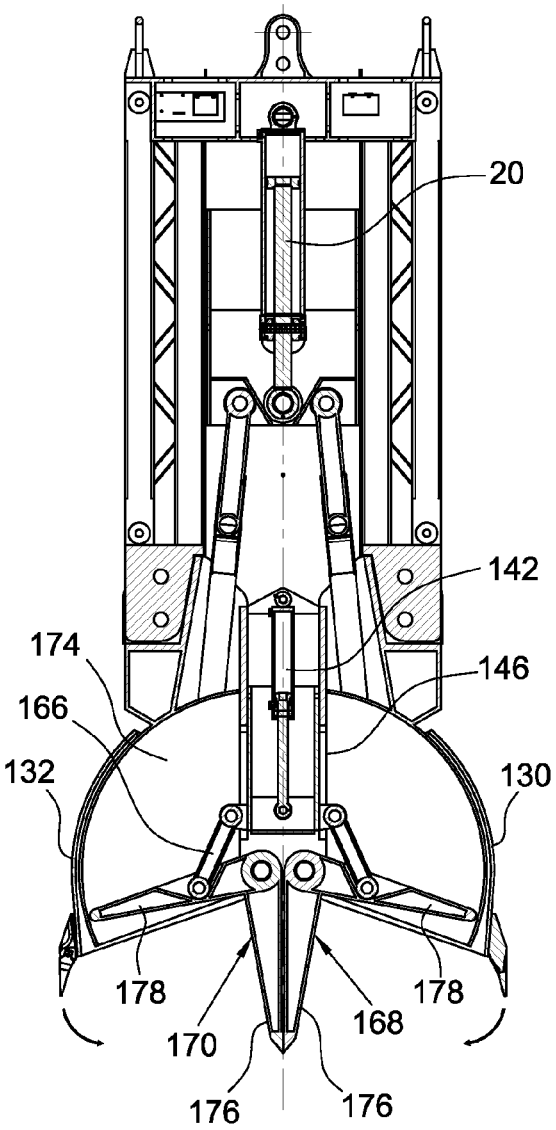
FIGS. 6A-6H show, in sequence, the different operating steps of a single operating cycle of the device for digging with a bucket of FIG. 4.
Figure 6B:
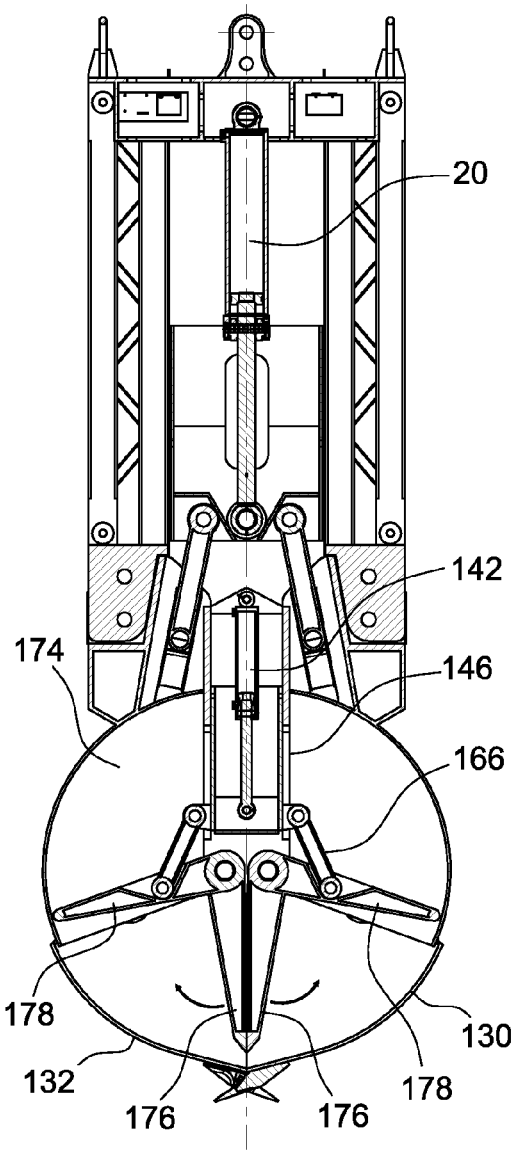
Figure 6C:
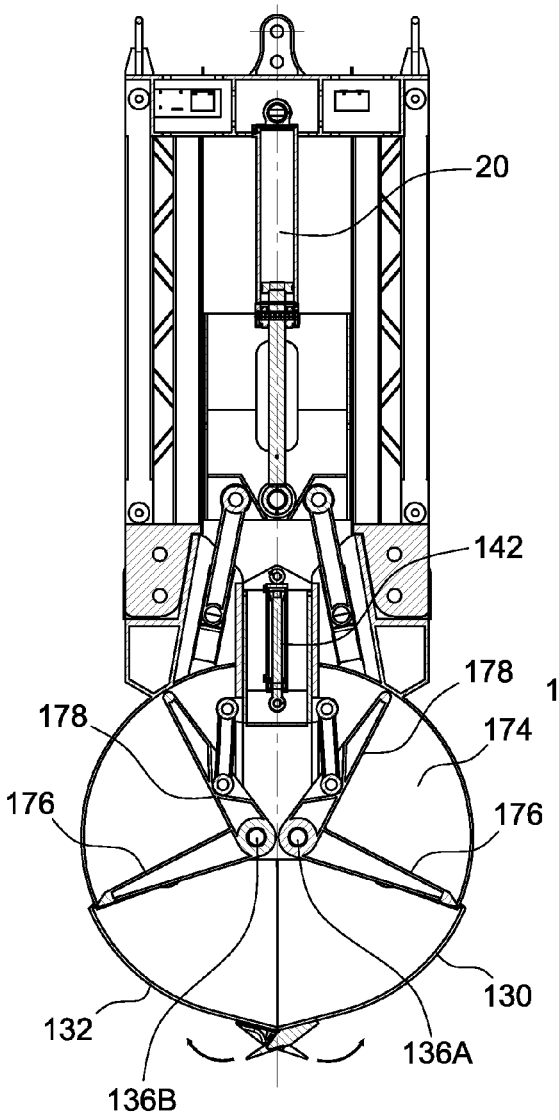
Figure 6D:
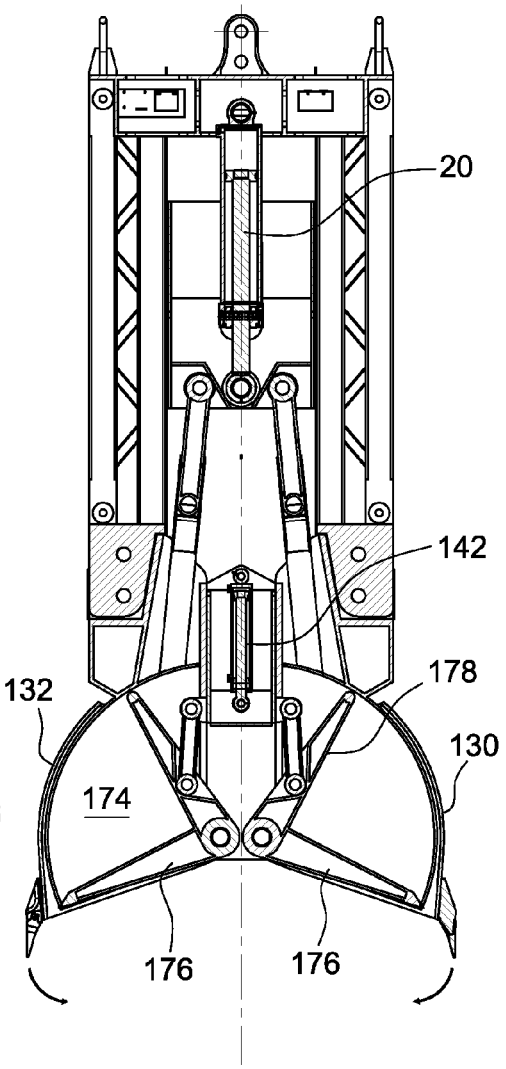
Figure 6E:
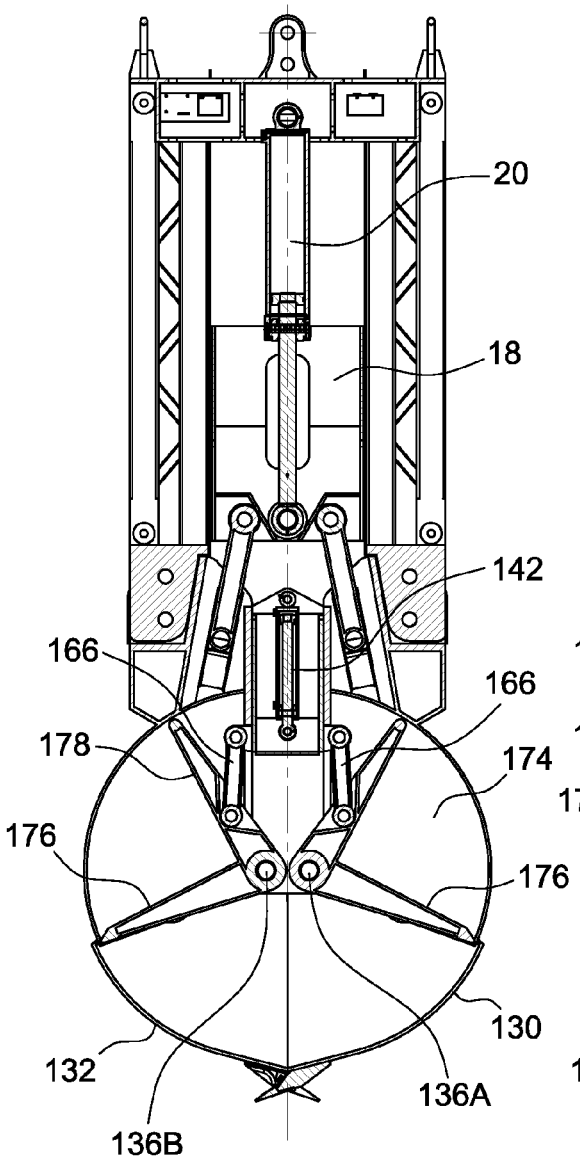
Figure 6F:
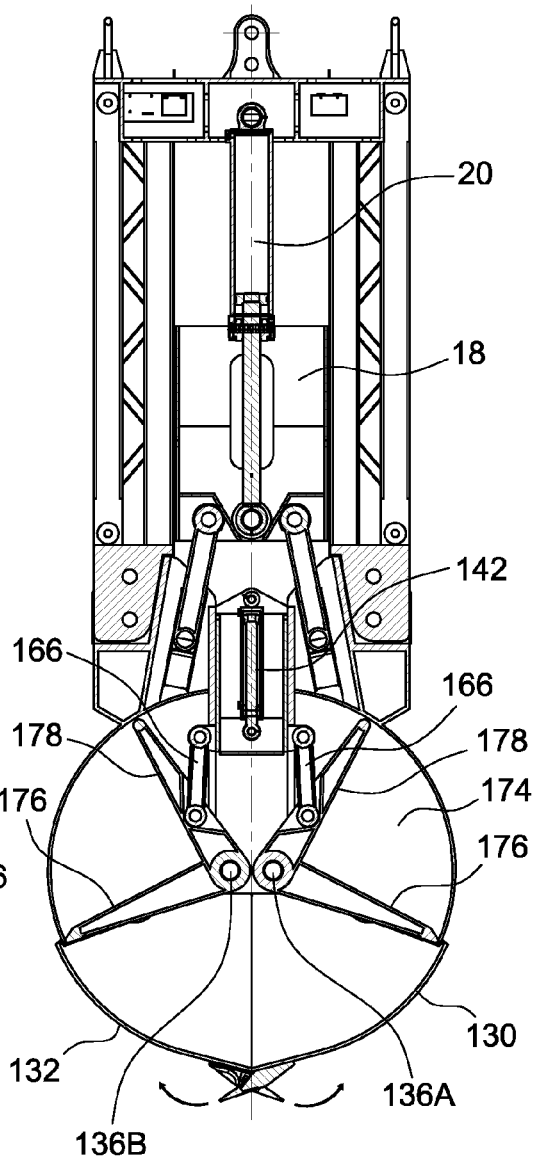
Figure 6G:
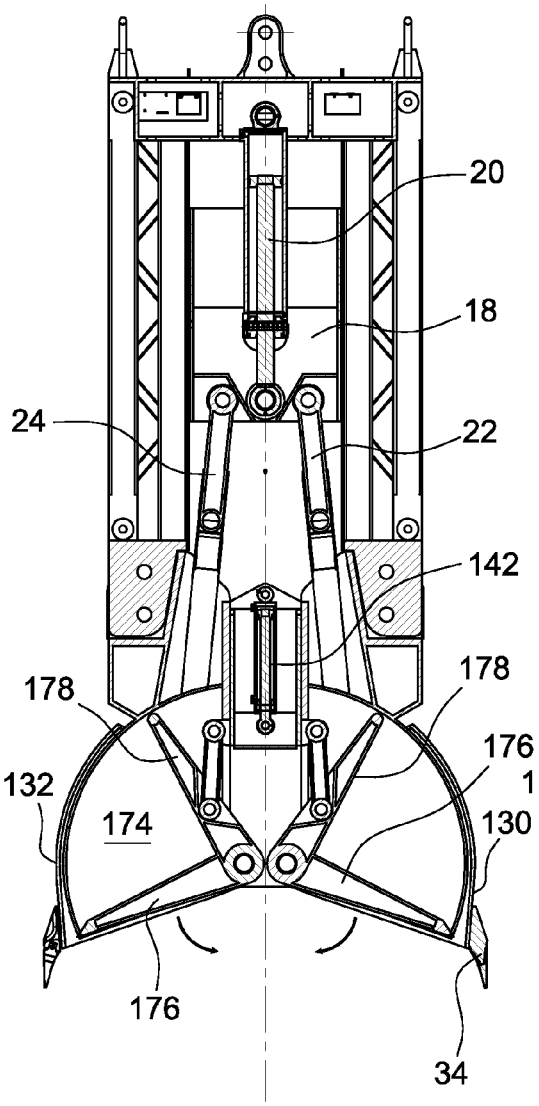
Figure 6H:
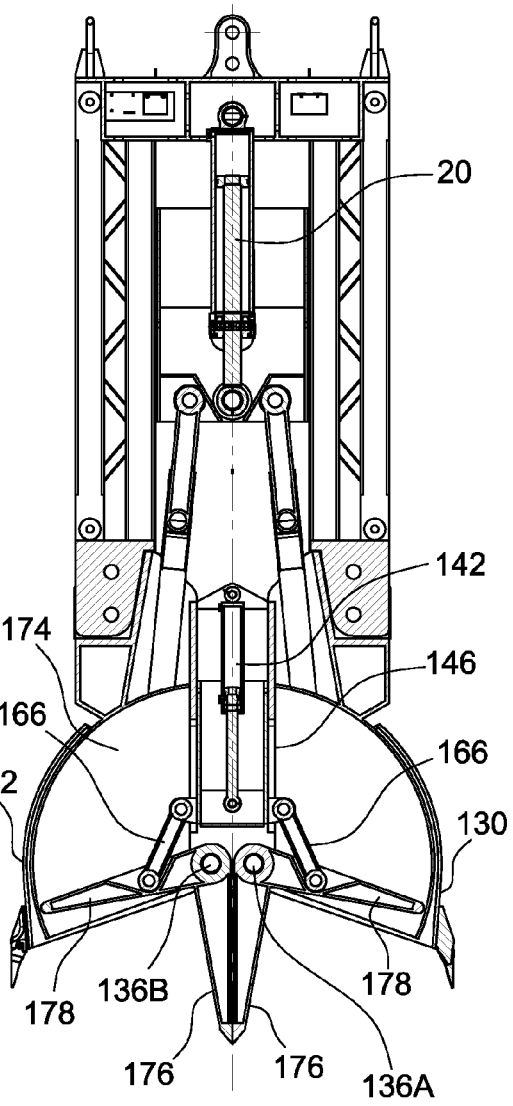

The arms of each bolt 168 and 170 consist of a central blade 176 and a peripheral blade 178 having a shorter width than that of the half-shells 130 and 132. Such a difference in width is equal to the sum of the thicknesses of the connecting rods 22 and 24. The bolts 168 and 170 are not equipped with teeth or protuberances configured to sink into the ground and thus do not have a digging function. Like in the first embodiment of the device 10, the connecting rods 22 and 24 are monolithic in their upper part, whereas they fork in their lower part to rotatably connect to the half-shells 130 and 132 through the respective pins 128 (FIG. 4). The bolts 168 and 170 thus have a width slightly smaller than the gap existing between the inner faces of the forked arms of the connecting rods 22 and 24.

The different operating steps of a single operating cycle of this second embodiment of the device 10 can therefore be summarised as follows. In a first step (FIG. 6A) the bucket, with the half-shells 130 and 132 empty and with the reservoir 174 empty, slides in descent into the excavation. The half-shells 130 and 132 are open, the first hydraulic cylinder 20 is closed and the second hydraulic cylinder 142 is withdrawn. The bolts 168 and 170 have the respective central blades 176 brought together, vertical and coinciding with the middle of the excavation. These central blades 176 come into contact first with the ground and have an anchoring function, in order to stabilize the bucket at the moment when the respective half-shells 130 and 132 start their closing movement. Moreover, in the case of use of the device 10 in hard and compact ground, such bolts 168 and 170 with vertical blade facilitate the penetration and breaking of the ground thanks to their wedging effect. In this case the lower tip of the central blades 176 is suitably made with cutting elements and extends beyond the depth from which the teeth 34 push out when the half-shells 130 and 132 are in open configuration.

In a second step (FIG. 6B) the first hydraulic cylinder 20 is withdrawn, whereas the second hydraulic cylinder 142 is kept open. The connecting rods 22 and 24 close the half-shells 130 and 132. This manoeuvre makes it possible to store the digging material between the two arms (central blade 176 and peripheral blade 178) of each bolt 168 and 170. In other words, at the end of this manoeuvre, a certain amount of digging material will have been separated inside the volume defined by the arms 176 and 178 of each bolt 168 and 170 and by the inner wall of the half-shells 130 and 132. In any case, a certain volume of material is separated and is ready to be enclosed inside a container (reservoir 174) that is preferably beneath the framework 12.

In a third step (FIG. 6C) the first hydraulic cylinder 20 is kept withdrawn to keep the half-shells 130 and 132 immobile in closed position, whereas the second hydraulic cylinder 142 is closed. The connecting rods 166 fastened to the second sliding trolley 146 set the bolts 168 and 170 in rotation about the respective pins 136A and 136B. This manoeuvre transfers the material trapped between the two arms 176 and 178 of each bolt 168 and 170, from its initial position (FIG. 6B) inside the half-shells 130 and 132, into an upper position inside the reservoir 174. In other words, the half-shells 130 and 132 remain closed but are emptied of a great deal of their material. The bolts 168 and 170 act as separation means to isolate the soil contained in the reservoir 174 with respect to the half-shells 130 and 132.

In a fourth and fifth step (FIGS. 6D and 6E) the second hydraulic cylinder 142 is kept closed. In the fourth step (FIG. 6D) the first hydraulic cylinder 20 carries out another closing stroke, so as to open the digging half-shells 130 and 132, while the material already dug and loaded is stored in the reservoir 174. The soil in the reservoir 174 is held by the separation means 168 and 170, whereas the pair of digging half-shells 130 and 132 is in open configuration.

In the fifth step (FIG. 6E) the first hydraulic cylinder 20 carries out an opening stroke, allowing the half-shells 130 and 132 to perform a second filling, whereas the material collected previously remains confined between the walls of the reservoir 174 and the two arms 176 and 178 of each bolt 168 and 170. Such a second filling takes place without extracting the bucket from the excavation. It should be noted that the bolts 168 and 170 move, each following its own rotation arc, inside the reservoir 174. The half-shells 130 and 132, on the other hand, when they carry out their rotation movement, transit outside of such a reservoir 174. In other words, in order to simplify the concept, the reservoir 174 is contained inside the half-shells 130 and 132 when such half-shells 130 and 132 are open. At the end of this fifth step, the bucket is loaded with a first amount of material enclosed in a first volume, which is the reservoir 174, and with a second amount of material enclosed in the second volume, which is defined by the digging half-shells 130 and 132. Such a first and second volume are distinct from each other.

In a sixth step (FIG. 6F) the entire device 10 rises towards the surface, with the half-shells 130 and 132 closed and full of material and the reservoir 174 also full of material. Once the surface has been reached, the device 10 is ready to be unloaded of material at the predefined collection point.

In a seventh step (FIG. 6G) the device 10 is at the surface, the first hydraulic cylinder 20 is closed and the connecting rods 22 and 24 open the half-shells 130 and 132 to empty out a part of the material loaded from the bucket. The bolts 168 and 170 are kept still and positioned inside the reservoir 174. The soil in the reservoir 174 is held by the separation means 52 and 54, whereas the pair of digging half-shells 130 and 132 is in open configuration and unloads. The central arm 176 of each bolt 168 and 170, arranged almost horizontally in this step, acts as an ejector facilitating the dropping of the material and the emptying of the half-shells 130 and 132.

In an eighth and last step (FIG. 6H) the second hydraulic cylinder 142 is withdrawn, whereas the first hydraulic cylinder 20 remains in closed position. The bolts 168 and 170, moved by the connecting rods 166, carry out a rotation about the respective pins 136A and 136B, transporting the volume of the material trapped between the walls of the reservoir 174 and the two arms 176 and 178 of the compass of which each bolt consists 168 and 170 downwards. The central arm 176 of one of the bolts 168 goes into vertical position, in contact with the corresponding central arm 176 of the other bolt 170. The peripheral arm 178 of each bolt 168 and 170, in its downward stroke, on the other hand, acts as a scraper, facilitating the emptying of the volume of material enclosed in the reservoir 174. The bucket is arranged like in the first step of FIG. 6A and is ready for another operating cycle.

It has thus been seen that the device for digging with a bucket according to the present invention achieves the objects highlighted earlier, in particular obtaining the following advantages. Such a device is first of all comparable, in weight and dimensions, to the buckets commonly in use. Indeed, many parts, including the framework, the first cylinder and the thrusting trolley, can be those normally produced, so as to implement the device according to the present invention even on existing buckets. Such an advantage can be obtained, for example, thanks to the fact that the half-shell support body is fixed to the framework with removable means. It is thus possible to change the type and size of the half-shells by disconnecting the half-shell support body and the half-shells themselves, keeping the framework, the first cylinder and the trolley unchanged. It is also not necessary to use a carrying machine of a higher class in order to operate such a device, because the increase in volume filled by additional soil leads overall to a small increase in weight to be lifted with respect to the solutions currently provided.

The storage capacity undergoes an increase of over 50% compared to a modest increase in the duration of the cycle, in this case in the loading and unloading steps. The length of the bucket is lengthened with respect to a conventional bucket to house the additional storage volume to that of standard half-shells close to the lower part of the framework.

In order to minimise the increase in duration of the operating cycle it is possible, in both of the embodiments described, to use the device according to the invention as a conventional bucket, giving up the "double load". If this solution is adopted, the second hydraulic cylinder 42 or 142 of the respective embodiment would remain closed and the half-shells (the outer ones in the first embodiment) would have the load capacity and the operating times of a conventional bucket. It is thus possible to use the device according to the present invention with the conventional digging method to dig the first tens of meters, where the digging and unloading times are longer than the descent and ascent times. At the moment where the proportion reverses, it is possible to set the option of "double load". This operation is limited to the manipulation of additional controls in the cabin of the carrying machine. Of course, it is possible to use the bucket in "double load" configuration right from the start of digging.

The device for digging with a bucket according to the present invention has good modularity. The main parts of the bucket are common to all of the digging sections. Other secondary mechanical parts of the bucket can be interchanged as a function of the width of the excavation to be carried out. All of the parts of the bucket are in any case easily assembled. The solution is also compatible with applications of means for correcting verticality (flaps, mobile shoes, grip rollers, etc.).

It is possible to convert the digging device from the configuration represented in FIGS. 2A and 2B to that of FIG. 4 intervening with the partial replacement of some elements positioned in its lower part (inner half-shells, bolts, trolleys, etc.), whereas for example the second hydraulic cylinder could remain the same. In this way, if it became necessary to make excavations in compact ground, it would be possible to convert the solution of FIGS. 2A and 2B into the one represented in FIG. 4, where the bolts have a greater penetration and therefore production capability.

The device for digging with a bucket according to the present invention thus conceived can in any case undergo numerous modifications and variants, all of which are covered by the same inventive concept; moreover, all of the details can be replaced by technically equivalent elements. In practice, the materials used, as well as the shapes and sizes, can be whatever according to the technical requirements. As an example, the rollers or pins 58 that abut on the rails 56 can be made in any type of mechanically abutting prismatic shape, not necessarily exploiting a rotation of a body (pin or roller) but simply a translation (sliding blocks, bushings, etc.).

The scope of protection of the invention is therefore defined by the appended claims.

The invention claimed is:

1. Device for digging diaphragms, comprising a framework and a half-shell support body, fixed in the lower part of the framework, which supports a first pair of half-shells moved to open and close by a first actuation system, the device further comprising a reservoir operatively connected to the first pair of half-shells to contain the soil dug by said half-shells, wherein the reservoir is positionable between the framework and the first pair of half-shells and said reservoir having a volume configured to contain an amount of soil substantially corresponding to the amount of soil dug by said half-shells during a single operating cycle of the device.

2. Device according to claim 1, further comprising separation means actuated for isolating the soil contained in said reservoir.

3. Device according to claim 1, wherein the reservoir comprises the volume enclosed by a second pair of half-shells moved by a second actuation system so as to be able to pass from a first operating configuration, wherein said second pair of half-shells is independent from the first actuation system of the first pair of half-shells, to a second operating configuration, wherein said second pair of half-shells is operatively connected to the first system for actuating the first pair of half-shells so that, in said second operating configuration, said second pair of half-shells is driven by said first pair of half-shells.

4. Device according to claim 3, wherein the shape of the half-shells of the second pair of half-shells is contained in the volume of the half-shells of the first pair of half-shells, so that said second pair of half-shells is configured to be inserted into said first pair of half-shells.

5. Device according to claim 3, wherein the second actuation system comprises a second hydraulic cylinder fixed—at the upper part—to the framework in the static part thereof and configured to move a second sliding trolley provided, in the lower part thereof, with a pair of pins on each one of which there is hinged a half-shelf of said second pair of half-shells.

6. Device according to claim 5, wherein at the sides of the second sliding trolley there are arranged ejection means, integral with said sliding trolley, for facilitating the unload of the soil when emptying said second pair of half-shells.

7. Device according to claim 3, wherein the first pair of half-shells and the second pair of half-shells, in the second operating configuration in which said second pair of half-shells is operatively connected to the first actuation system of the first pair of half-shells, are mutually constrained through respective mechanical means.

8. Device according to claim 7, wherein the mechanical means are mutually engaged for a limited stroke portion of the second hydraulic cylinder, so as to allow the inner half-shells to be disengaged from the external valves so as to reach said first operating configuration.

9. Device according to claim 7, wherein said mechanical means include a track, fixed on both lateral walls of each half-shell of a pair selected between said first pair of half-shells and said second pair of half-shells, and of at least one abutment means, obtained on both lateral walls of each half-shell of the other pair selected between said first pair of half-shells and said second pair of half-shells, wherein each abutment means is engaged with a track.

10. Device according to claim 9, wherein each abutment means include a pair of rollers or idle pins which are engaged at the two opposite sides of each track.

11. Device according to claim 2, wherein the separation means include the walls or shells of said second pair of half-shells.

12. Device according to claim 2, wherein the separation means include a pair of mechanisms at least partially housed within the reservoir and rotated by a second actuation system for selectively performing both the transfer—within said reservoir—of the soil contained in said first pair of half-shells and the ejection of the soil from said reservoir.

13. Device according to claim 12, wherein the second actuation system comprises a second hydraulic cylinder fixed to the framework or to the half-shell support body in the static part thereof and configured for moving a second sliding trolley.

14. Device according to claim 12, wherein each of said mechanisms consists of a compass structure provided with two arms open according to a predefined angle.

15. Device according to claim 14, wherein said mechanisms are hinged on pins around which also the half-shells of said first pair of half-shells rotate and wherein said mechanisms receive the rotation movement thereof from said second actuation system.

16. Device according to claim 1, wherein the reservoir is configured to be contained within the half-shells of said first pair of half-shells when said half-shells are open.

17. Device according to claim 1, wherein the reservoir is open at its upper part so as to improve the outflow of drilling fluid.

* * * * *